US005447243A

United States Patent [19]

Graber

[11] Patent Number: 5,447,243

[45] Date of Patent: * Sep. 5, 1995

[54] DRAWING TOOL HOLDER & ORGANIZER

[76] Inventor: Richard B. Graber, Box 1234, Los Gatos, Calif. 95031-1234

[ * ] Notice: The portion of the term of this patent subsequent to Feb. 16, 2011 has been disclaimed.

[21] Appl. No.: 273,932

[22] Filed: Nov. 21, 1988

[51] Int. Cl.[6] ..... A47F 7/00

[52] U.S. Cl. ..... 211/69.5; 211/41; 211/70.6; 211/13; 206/371

[58] Field of Search ..... 211/69.5, 69, 70.6, 211/11, 41, 89, 13; 206/371, 224

[56] References Cited

U.S. PATENT DOCUMENTS

| | | | |
|---|---|---|---|
| 1,092,156 | 4/1914 | Mathis | 211/69.1 |
| 3,176,662 | 4/1965 | Williams | 211/69.5 |
| 3,365,761 | 1/1968 | Kalvig | 211/89 X |
| 3,481,452 | 12/1969 | Pickios | 206/224 |
| 3,487,947 | 1/1970 | Bogar, Jr. | 211/89 X |
| 3,603,551 | 9/1971 | Peterson | 211/70.6 X |
| 3,620,362 | 11/1971 | Valdes | 206/224 |
| 4,176,743 | 12/1979 | Fitzpatrick | 206/214 |
| 4,265,362 | 5/1981 | Suonvieri | 211/69.1 |
| 4,374,565 | 2/1983 | Neumann | 211/69.5 |
| 4,406,368 | 9/1983 | Hermes | 211/69.1 X |
| 4,475,650 | 10/1984 | DeFazio, Jr. | 206/371 |
| 4,690,285 | 1/1987 | Stone | 211/41 |

*Primary Examiner*—Blair M. Johnson

[57] ABSTRACT

A drawing tool holder and organizer consists of a plurality of staged receptacles, a block of compressive material with partial slits, (**26*b*) and a corresponding base plate (28**). The plurality of staged receptacles are molded into the base plate for holding pointed instruments, point-down, with a shelf in each receptacle for holding the body of the instrument and protecting its tip. The volume of resilient compressive material has sufficient elasticity, when partially divided by slits, to releasably grip flat instruments. A decorative cover can be used for aesthetic considerations, attaching to base plate. The base plate can be mounted with adhesive, double-stick tape, clamping, etc.

1 Claim, 4 Drawing Sheets

DRAWING TOOL HOLDER & ORGANIZER

BACKGROUND—FIELD OF THE INVENTION

The present invention relates to a drawing tool holder and organizer, particularly to such a holder which can accommodate most of the widely used drawing implements.

BACKGROUND—PRIOR ART

Any person that uses conventional drawing equipment requires an assortment of specialized instruments, including precision pens, lead holders, templates, triangles, compasses, erasers, and many others too numerous to list here. Such a person (artist or drafter, hereafter artist) will use them randomly during the course of activity, usually creating disorganized clutter. In the past, artists have used trays, drawers, hooks, cups, distributor caps, record holders, and other devices to hold their instruments and bring a degree of organization to their workplace. However, since the drawing board or drafting table is typically a large slanted surface with little, if any, space to store or place drawing tools or holders, therefore the instruments and their holders tended to slide off when placed on the surface. Since such instruments are precision items which are costly and easily damaged, the problem is especially acute.

Most users of conventional drawing instruments would find it desirable to have a device which could organize and hold drawing tools in a most beneficial way and which could allow "at fingertip" placement convenience.

The problem of providing a suitable holder also is compounded because of the variety of shapes and sizes of drawing instruments. The holder must releasably grip flat items, protect the tips of stored pointed instruments, and be able to hold other instruments having a wide variety of forms.

Heretofore drawing tool holders and organizers were bulky, elaborate, and could only be placed in a very limited number of locations. In addition to limited placement convenience, most such holders were dependent on gravity as the primary means of holding objects in position. For example, the template holder in U.S. Pat. No. 4,406,368 to Hermes, 1983 Sep. 27, had no gripping means, making it dependent on gravity to retain instruments. In addition, although it had cavities for elongated instruments, it provided no protection for pointed instruments, such as pencils and pens. Also, Hermes's device required a desk or table for clamping or resting.

A device for releasably holding relatively slim articles, shown in U.S. Pat. 4,265,326 to Suonvieri, 1981 May 5, is a complex structure that is limited in reconfigurability and mounting flexibility, as is the aperture tray and disinfectant pad in U.S. Pat. 1,092,156 to Mathis, 1914 Apr. 7.

A draftsman's kit, shown in U.S. Pat. 3,481,452 to Pickios, 1969 Dec. 2, was bulky, limited in storage versatility and had to be placed on a table.

None of these devices was able releasably to grip flat instruments and hold pointed, cylindrical objects, with tips protected and none was infinitely configurable for versatile placement capability.

OBJECTS AND ADVANTAGES

Therefore one principal object and advantage of the present invention is to provide a device capable of holding drawing tools in a novel way that enhances the efficiency of the drafter or artist. Further objects are to provide a device for releasably gripping flat instruments so that the device can be placed on slanted or vertical surfaces, to provide a device for storing pointed instruments without damaging their tips, to provide a device which has configuration flexibility so that it may be made with relatively small size and low mass, and to provide a device which has versatile placement convenience so as to allow a maximum variety of mounting locations. Other objects and advantages of this invention will become apparent from a consideration of the drawings and ensuing description.

DRAWING FIGURES

DRAWING REFERENCE NUMERALS

Figure 1:
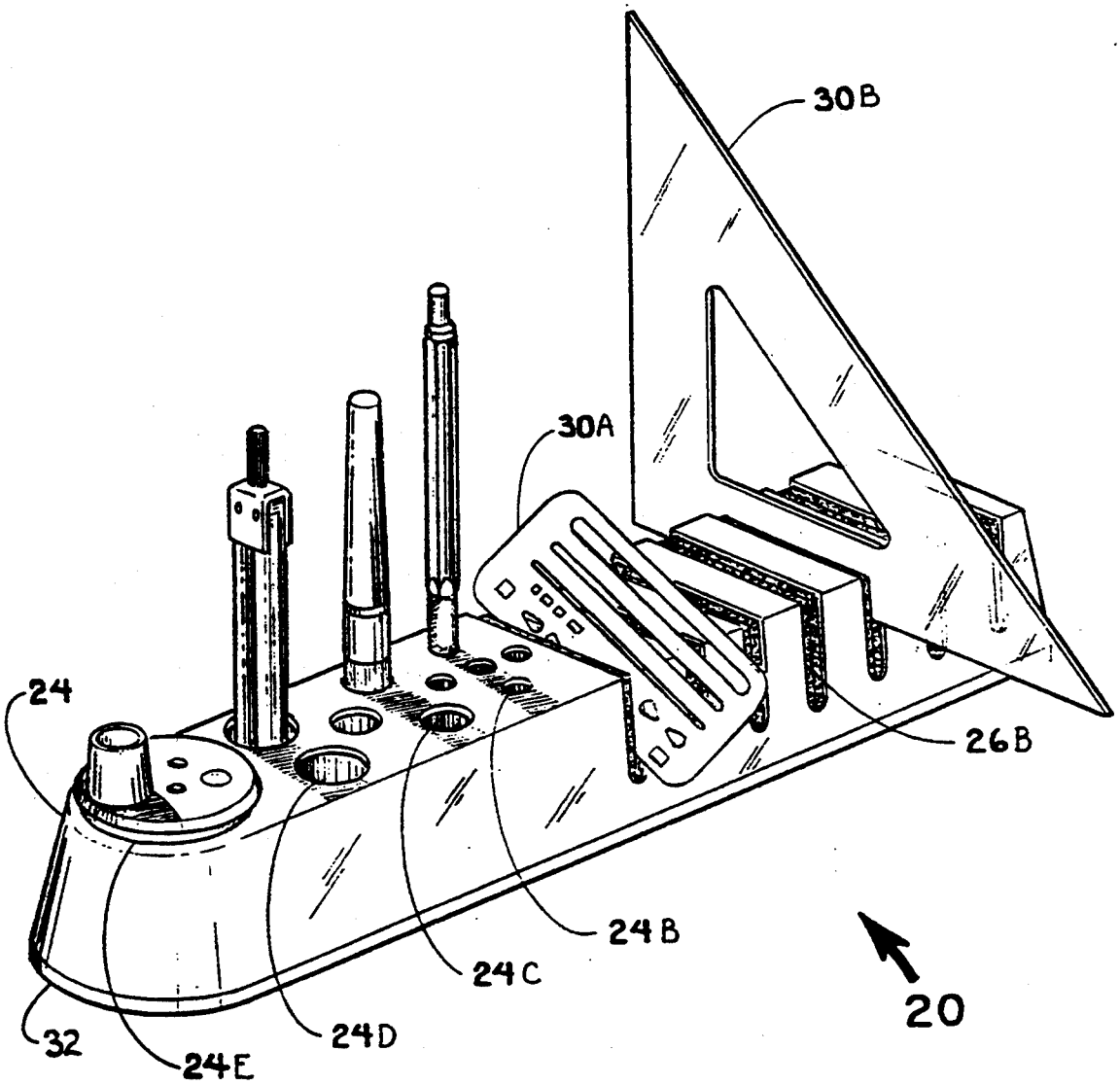
FIG. 1 is a perspective view of a drawing tool holder and organizer according to the present invention.

20 Drawing tool holder and organizer
*22a* Upper receptacle stage
*22b* Toot rest shelf
*22c* Lower receptacle stage
*22d* Precision marking implement
*22e* Body of *22d*
*22f* Tip of *22d*
24 Decorative upper shell
*24a* Slot
*24b* Small receptacles (sized for pencil)
*24c* Medium-size receptacles (sized for pen)
*24d* Large receptacle (sized for general drafting implements)
*24e* Larger receptacle (for pencil sharpener or general storage)
26 Flat instrument holder
*26a* Block of polyfoam
*26b* Slit in *26a*
28 Base plate
30 Flat instrument (such as template, triangle, etc.)
*30a* Thin flat instrument 30*b* Medium flat instrument
30*c* Thick flat instrument
32 Integral-receptacles base plate
34 Joint
36 Sheet form of 26*a*
Support structure
38*a* Groove in 38
38*b* Wall of 38*a*
40 Specialized modules
40*a* Pencil module (of 24*b*)
40*b* Pen module (of 24*c*)
40*c* Instrument module (of 24*d*)
40*d* General storage module (of 24*e*)
40*e* Flat instrument module (of 26)
42 Double-stick tape
44 Clamping device
44*a* Clamping recess
46 Flat surface
46*a* Drafting board
46*b* Storage box
46*c* Lamp
46*d* Drafting machine
46*e* File cabinet

DRAWING TOOL HOLDER AND ORGANIZER—DESCRIPTION

FIG. 1

FIG. 1 shows a drawing tool holder and organizer (hereinafter holder) 20 according to the present invention, in assembled form, holding typical drawing instruments. As shown it can hold triangles, erasing shields, pencils, pens, dividers, and a pencil sharpener in readily-accessible manner. The typical dimensions of the device in FIG. 1 are approximately 25.4 cm (10") long ×5.1 cm (2") wide ×5.1 cm (2") high, but can vary depending on the configured storage capacity of the device. The holder is in the shape of a base plate with a plurality of vertical cylinders of various diameters protruding from said baseplate which has attached, in adjacent position, a block of polyfoam. The decorative upper shell is in the shape of an elongated block, which slope so that the base is wider than the top. On the left end, the slope curve to form a partial cone shape that continuous with the long sides. The opposite end is sloped and flat.

FIG. 2 & 4

Figure 2:
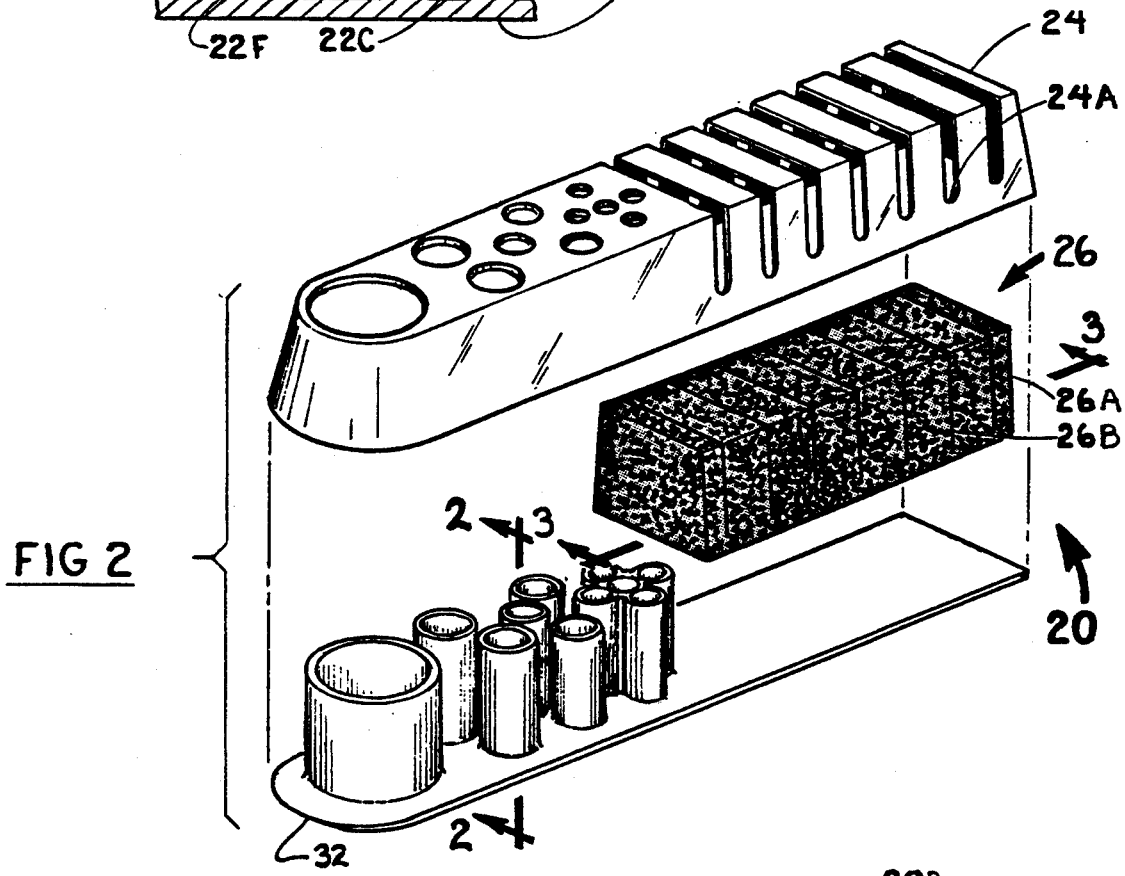
FIG. 2 is an exploded perspective view of a drawing tool holder and organizer.
Figure 4:
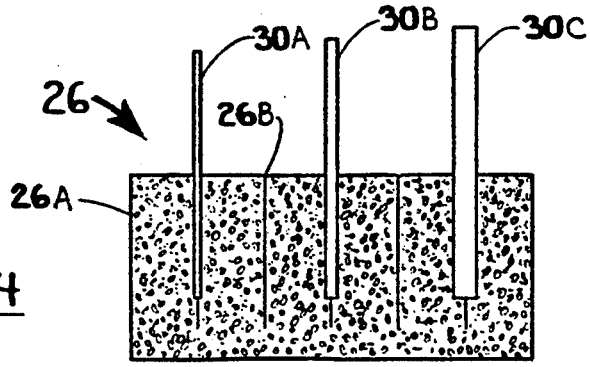
FIG. 4 is a cross-sectional view of a drawing tool holder and organizer of FIG. 2 taken along line 3—3.

FIG. 2 shows an exploded perspective view of holder 20 and FIG. 4 side view thereof. It comprises a flat instrument holder 26 consisting of a block of polyfoam 26*a* or any other block of compressible material, with slit(s) 26*b* running from the block's top surface to approximately ¾ down to the bottom and a base plate 32 which has integral receptacles 24*b* to 24*e*.

Base plate 32 contains a plurality of appropriately-sized receptacles for holding an assortment of drawing tools. Specifically it has a plurality of small receptacles 24*b*, a plurality of medium-size receptacles 24*c*, a plurality of large receptacles 24*d* for various drafting tools, a larger receptacle 24*e* for a pencil pointer or general storage. FIG. 4 shows a side view of holder 26 with flat instruments (30*a*, 30*b*, 30*c*) of various thickness inserted into slits 26*b*.

FIG. 3

Figure 3:
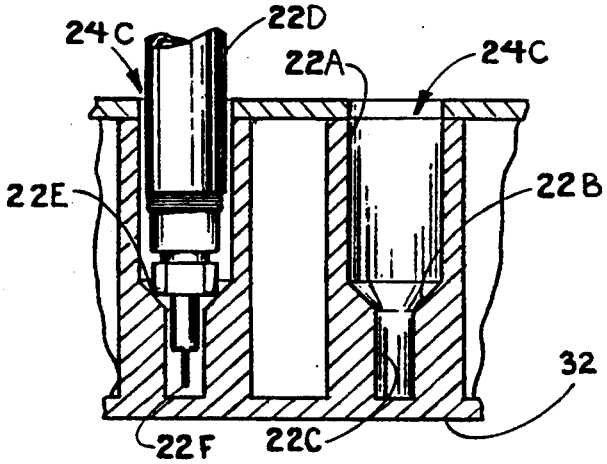
FIG. 3 is a cross-sectional view of a drawing tool holder and organizer of FIG. 2 taken along line 2—2.

Receptacles 24*b* and 24*c* are staged as shown in FIG. 3. Staged receptacle 24*c* consists of a wide upper portion or stage 22*a* of appropriate diameter to provide clearance for the body of a cylindrical instrument, such as a pencil or pen. A shelf or ledge 22*b*, of appropriate slope, provides guidance and support for the instrument. And a lower portion 22*c*, of appropriate diameter and length allows a pencil or pen 22*d* (shown in the receptacle 24*b*) to rest with the tower end of its body part 22*e* on the ledge so that its tip 22*f* will not touch base plate 28.

FIG. 5

Figure 5:
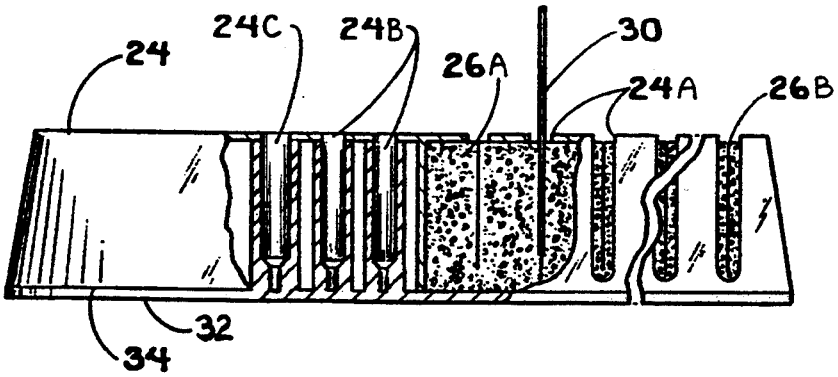
FIG. 5 is a side view with partial broken-out sections of the drawing tool holder and organizer.

FIG. 5 shows the holder assembled, in side view and in partial cross-section.

FIG. 6

Figure 6:
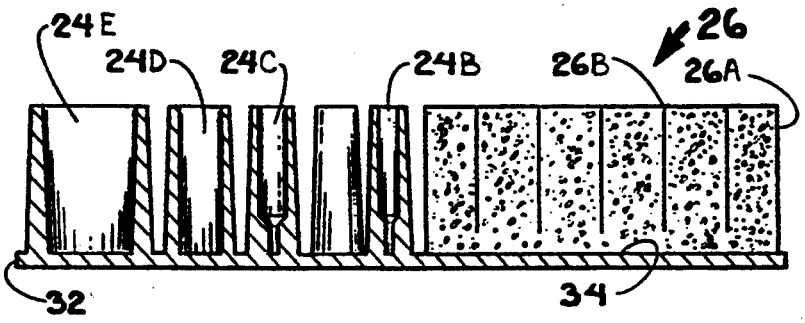
FIG. 6 is a side view cross sectional depicting a variation to the drawing tool holder and organizer.

FIG. 6 shows an alternative embodiment wherein the receptacles are integrally molded with the base and the flat instrument holder is affixed to the top of the base adjacent to the receptacles. No cover is utilized in this embodiment.

FIG. 7

Figure 7:
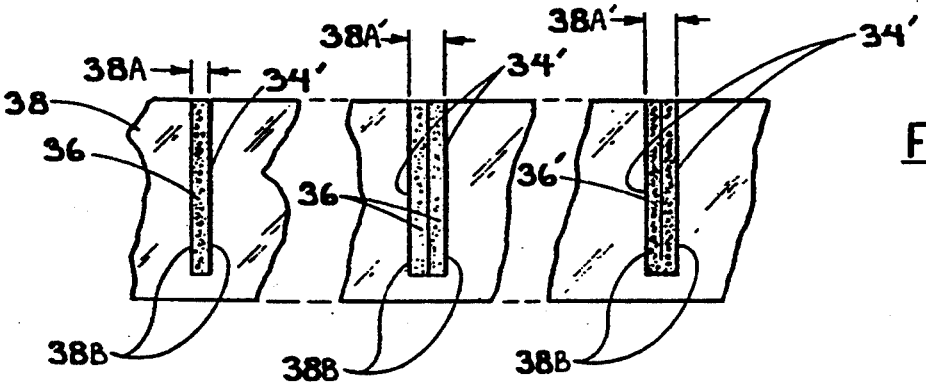
FIG. 7 is a side view depicting variations of the flat instrument-gripping part of the drawing tool holder and organizer.

FIG. 7 depicts a side view of an alternative flat instrument holder which is configured from polyfoam. In the holder of FIG. 7, in lieu of block 26*a* (FIG. 2), it employs a sheet of polyfoam 36. Sheet 36 can either be (a) a single sheet inserted into a groove 38*a* of a support structure 38 and attached to a wall 38*b* of the groove at 34', e.g., by adhesive or double-stick tape, (b) two similiar sheets 36 inserted into groove 38*a*' or (c) one folded over single sheet 36' inserted into a similiar groove 38*a*'. Grooves 38*a* and 38*a*' can be sawn kerfs in a block of wood, or they can be molded into a plastic form.

FIG. 8

Figure 8:
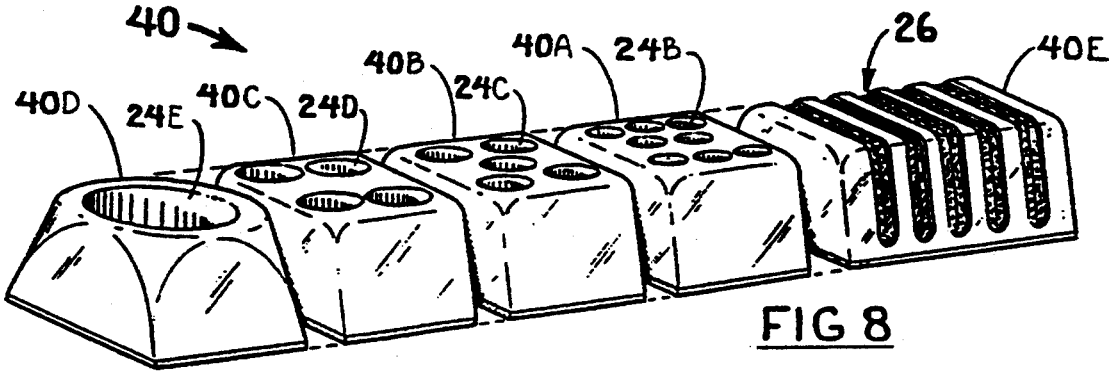
FIG. 8 is a perspective view depicting a modularly configured drawing tool holder and organizer.

FIG. 8 shows an alternative configuration in which modules 40 are used. This configuration provides the same basic function as the holder of FIG. 1, while employing similar fabrication and attachment methods. Rather than combining the functional features (i.e., small receptacles 24*b*, medium-sized receptacles 24*c*, large receptacles 24*d*, larger receptacle 24*e*, and flat object holder 26) into a single integrated device, each functional feature is grouped into its own separate individual module. This configuration provides a pencil module 40*a* with a plurality of smal receptacles 24*b*, a pen module 40*b* with a plurality of medium-sized receptacles 24*c*, an instrument module 40*c* with a plurality of large receptacles 24*d*, a general storage module 40*d* with larger receptacle 24*e*, and a flat instrument module 40*e* with flat instrument holder 26.

DRAFTING TOOL HOLDER AND ORGANIZER—OPERATION

To use the holder, flat instruments, such as triangles, erasing shields, and rulers, are placed into slots 24*a* (FIGS. 2 & 5) and then into slits 26*b* where they are firmly gripped by friction from polyfoam block 26*a*, regardless of the holder's orientation. The instruments are simply lifted out for use and replaced directly. Elongated writing instruments are placed into receptacles such as 24*c* (FIG. 3), point first, where they are held upright, yet with points protected.

FIGS. 9, 10, 11, 12

Figure 9:
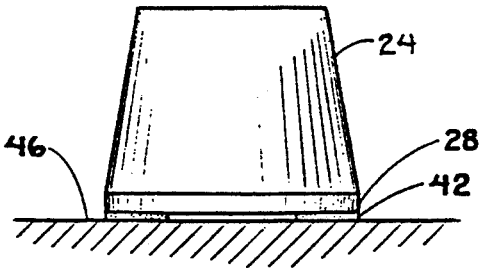
FIG. 9 is an end view of a drawing tool holder and organizer mounted on a flat surface with double-stick tape.
Figure 10:
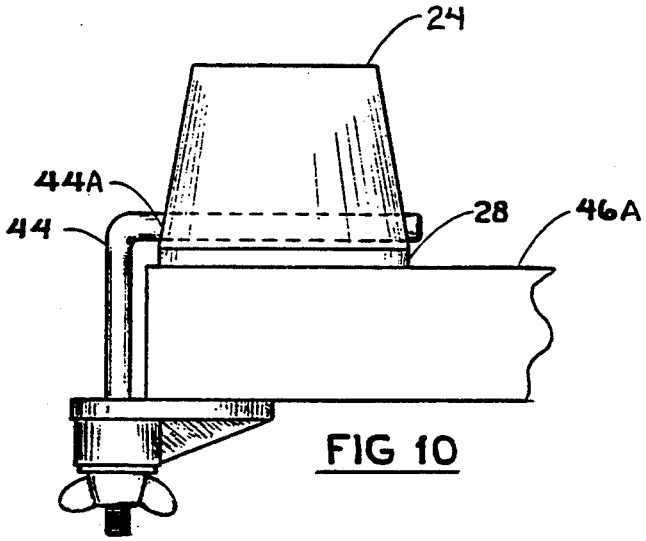
FIG. 10 is an end view of a drawing tool holder and organizer mounted on a flat surface with a temporary clamping device.
Figure 11:
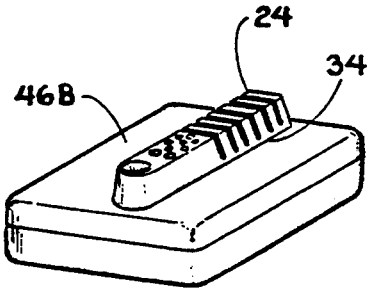
FIG. 11 is a perspective view of a drawing tool holder and organizer mounted on a flat surface with adhesive bonding means.
Figure 12:
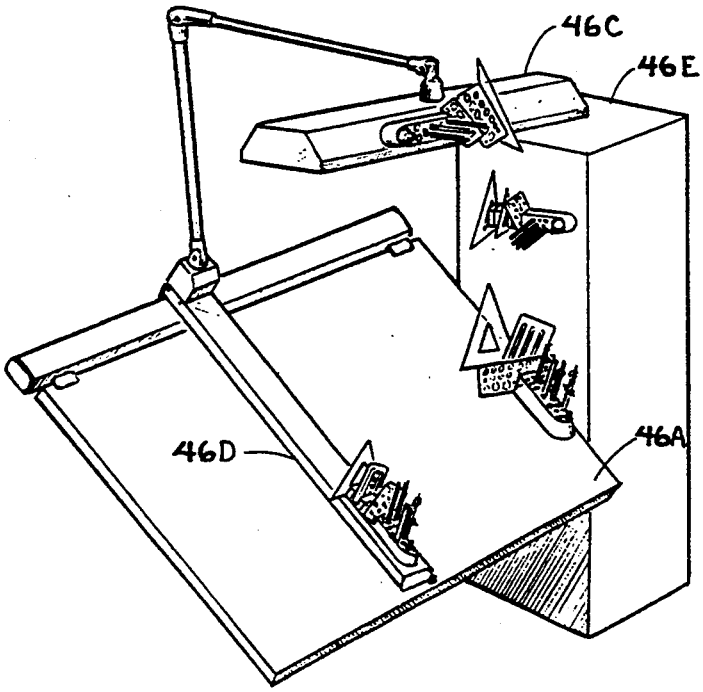
FIG. 12 is a perspective view of a drawing tool holder and organizer in use depicting typical instrument placements.

The holder has versatile mounting capability. As shown in FIG. 9, base plate 28 can be mounted to a flat surface 46 with double-stick tape 42. As shown in FIG. 10, a clamping recess 44*a* can be provided in the lower part of the holder's body and the holder can be temporarily held to flat surface of drafting board 46*a* by an L-shaped clamping device 44 that has an arm which is inserted in recess 44*a*. Recess 44*a* can be a hole in upper shell 24. FIG. 11 depicts the holder attached, which is joined by adhesive at 34, to the flat upper surface of an instrument storage box 46*b*. In FIG. 12 the holder is shown in some of the possible mounting locations available in a typical drafter or artist's work area. As shown, the holder can be placed on the flat surface of a drafting board 46*a*, the flat surface of a lamp 46*c*, adhesively attached to the flat surface of a drafting machine 46*d*, or the flat surface of a file cabinet 46*e*.

SUMMARY, RAMIFICATION AND SCOPE

Thus the reader will see that the drawing tool holder and organizer of the invention provides a highly reliable, lightweight, versatile, yet economical device which will enhance the efficiency of anyone who use the conventional drafting techniques. It will securely and reliably hold, yet readily release writing and flat instruments of various lengths and widths and can be mounted virtually anywhere.

While my description contains many specificities, these should not be construed as limitations on the scope of the invention, but rather as an exemplification of several preferred embodiments thereof. Many variations are possible. For example, a wedge-shaped structure, cylindrical, spherical or any other geometric form appropriate to intended use. Also, many different materials (i.e., plastic, wood, metal, etc.) can be used in its construction conducive to conventional manufacturing techniques. Accordingly, the scope of the invention should be determined not by the embodiments illustrated, but by the appended claims and their legal equivalents.

I claim:

1. A drawing tool holder and organizer comprising:

a base;

a plurality of receptacles integrally molded on an upper surface of said base, each said receptacle being staged and consisting of a cylinder with a relatively large diameter upper portion, a relatively narrow diameter lower portion, and an angled shelf connecting said upper and lower portions, said receptacles adapted for storing a plurality of pointed, cylindrical objects of a general variety, without allowing such objects to rest on their ends; and a block of resilient, compressive material containing a plurality of parallel, spaced slits, extending partially into said block from one side thereof for releasably gripping a respective plurality of flat objects, said block being fixedly mounted on the upper surface of said base adjacent said plurality of receptacles.

* * * * *